US010891821B2

(12) United States Patent
Swaine et al.

(10) Patent No.: US 10,891,821 B2
(45) Date of Patent: Jan. 12, 2021

(54) CONFIGURABLE AND MODULAR TRANSACTION TERMINAL

(71) Applicant: NCR Corporation, Atlanta, GA (US)

(72) Inventors: Steve Swaine, Perth (GB); Grant Charles Paton, Dundee (GB); Charles G V Rohan, Edinburgh (GB)

(73) Assignee: NCR Corporation, Atlanta, GA (US)

( * ) Notice: Subject to any disclaimer, the term of this patent is extended or adjusted under 35 U.S.C. 154(b) by 65 days.

(21) Appl. No.: 16/416,570

(22) Filed: May 20, 2019

(65) Prior Publication Data

US 2020/0066079 A1 Feb. 27, 2020

Related U.S. Application Data

(63) Continuation-in-part of application No. 16/112,751, filed on Aug. 26, 2018.

(51) Int. Cl.

| | |
|---|---|
| ***G07D 11/40*** | (2019.01) |
| ***G07F 19/00*** | (2006.01) |
| ***G07D 11/60*** | (2019.01) |
| ***A47F 9/04*** | (2006.01) |

(52) U.S. Cl.

CPC ..... *G07D 11/40* (2019.01); *A47F 9/046* (2013.01); *G07D 11/60* (2019.01); *G07F 19/201* (2013.01); *G07F 19/205* (2013.01); *A47F 2009/041* (2013.01)

(58) Field of Classification Search

CPC .... G06Q 20/1085; G07D 11/00; G07F 19/00; G07F 19/20; G07F 19/205

USPC ..... 235/379, 375; 705/35–45

See application file for complete search history.

(56) References Cited

U.S. PATENT DOCUMENTS

2007/0045397 A1* 3/2007 Ireland ..... G07F 19/203 235/379

2017/0308877 A1* 10/2017 Cha ..... G06Q 20/18

* cited by examiner

*Primary Examiner* — Edwyn Labaze

(74) *Attorney, Agent, or Firm* — Schwegman, Lundberg & Woessner

(57) ABSTRACT

A terminal is provided. The terminal includes a horizontal touch-based operating surface, a first vertical support side car, and a second vertical support safe enclosure. The operating surface includes integrated transaction devices that perform transaction processing on the terminal. The operating surface can be dynamically switched between a self-service mode of operation, an assisted service mode of operation, and a teller-service mode of operation. Each mode of operation dynamically orients displayed information on the operating surface to a particular side or both sides of the operating surface and selectively activates and deactivates the integrated devices.

20 Claims, 17 Drawing Sheets

CONFIGURABLE AND MODULAR TRANSACTION TERMINAL

RELATED APPLICATIONS

The present application is a Continuation-In Part of and is co-pending with U.S. application Ser. No. 16/112,751, entitled: "Automated Teller Machine with Three Modes," filed on Aug. 26, 2018; the disclosure of which is incorporated by reference herein in its entirety.

BACKGROUND

Enterprises typically offer a variety of ways in which customers can be served, such as self-service, teller-service, and assisted-service. Typically, specific terminals are configured and used for each mode of customer service. Often, dedicated terminals are used for each type of service. When terminals are capable of operating in different modes of service, such terminals require manual configuration and may require rebooting into a specific mode of service. Conditions change within an enterprise, such that rebooting and reconfiguring terminals can be problematic and can substantially delay customer transaction throughput.

Furthermore, most Self-Service Terminals (SSTs) are not accessible to people in wheelchairs with a front approach in a self-assisted mode of operation. Moreover, governments are mandating that any service provided to non-disabled customers of a business must be provided to disabled customers in a manner that accommodates the disabled customers.

SUMMARY

In various embodiments, configurable and modular transaction terminals are presented.

According to an embodiment, a transaction terminal is presented. The transaction terminal includes a horizontal operating surface comprising a touchscreen display; a first vertical support comprising first integrated devices; and a second vertical support comprising second integrated devices. A bottom portion of the horizontal operating surface rests on tops of the first vertical support and the second vertical support. The terminal is configured to dynamically switch between different modes of operation based on touch interaction with the touchscreen display, and each mode of operation configured to: activate selective first integrated devices and selective second integrated devices; and orient displayed information in the touchscreen display to one side or both sides of the horizontal operating surface.

DETAILED DESCRIPTION

Figure 1:
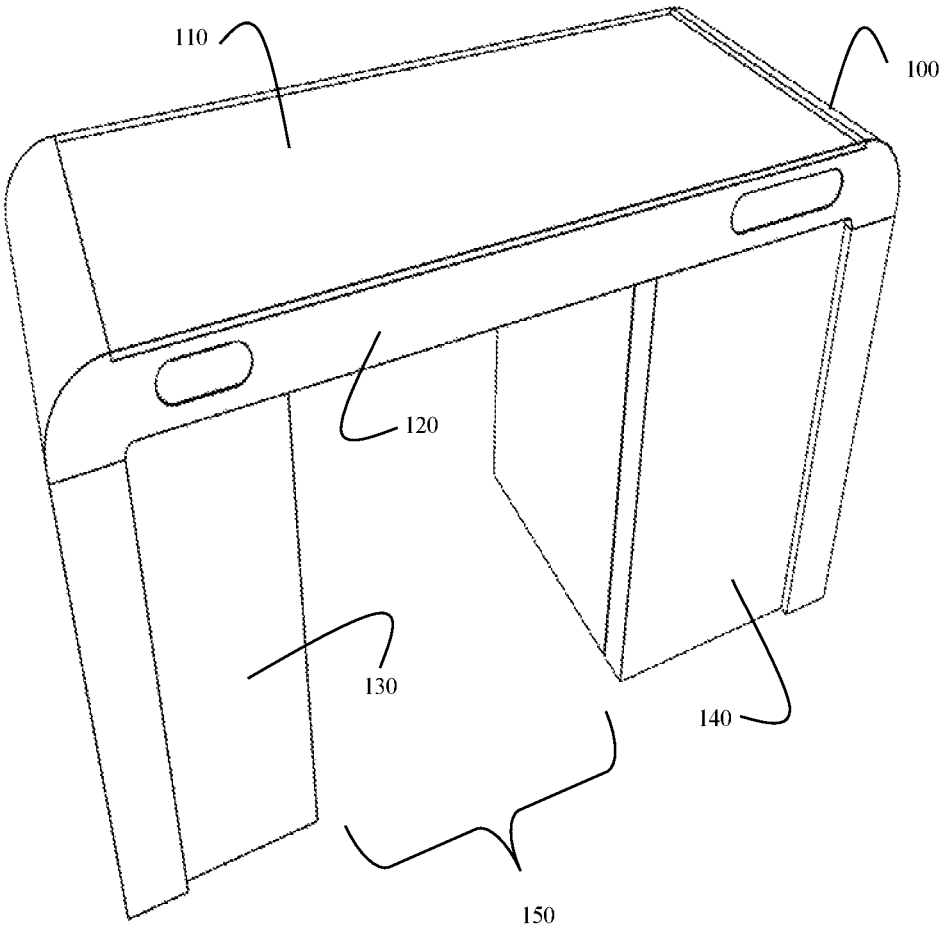
FIG. 1 is a diagram of a transaction terminal, according to an example embodiment.

FIG. 1 is a diagram of a transaction terminal 100, according to an example embodiment. It is to be noted that the components are shown schematically in greatly simplified form, with only those components relevant to understanding of the embodiments being illustrated.

Furthermore, the various components (that are identified in the FIG. 1) are illustrated and the arrangement of the components is presented for purposes of illustration only. It is to be noted that other arrangements with more or less components are possible without departing from the configurable and modular transaction terminal 100 presented herein and below.

As used herein and below, the terms "customer" and "consumer" may be used interchangeably and synonymously.

Furthermore, the terms "clerk," "cashier," and "teller" may be used interchangeably and synonymously.

An "operator" refers to an individual interacting with a user-interface of terminal 100 during a transaction. The operator is transitory such that during any given operation an operator can switch during the transaction between a customer and a teller based on who is interacting with a touchscreen interface 110 of terminal 100 during the transaction.

Transaction terminal 100 (herein after just "terminal 100") includes a variety of configurable and modular components as discussed herein and below in FIGS. 1-17. Terminal 100 includes a primary operator Terminal 100 includes a processor and non-transitory computer-readable storage media having executable instructions (not shown in the FIGS.). The executable instructions provide transaction processing, a user interface for touch-based interaction, wireless device interaction, payment card interaction, imaging scanning, image capture, image processing, video processing, media processing (receipt and dispense), and/or voice-based interaction.

Terminal 100 includes an operating surface 110, a side surface 120, a sidecar 130, and a valuable media depository 140.

Operating surface 110 includes a touchscreen display interface 111, document scanner 112, contactless card reader 113, and, optionally, a bar code/Quick Response (QR) code reader 114.

Side surface 120 includes a receiving media interface 121 and a dispensing media interface 122. In some instances, the receiving media interface 122 and dispensing media interface 122 are integrated as a single media pocket interface at either 121 and/or 122.

Side car 130 may include a receipt/document printer, a check deposit bin, coin dispenser, and/or document printer.

Valuable media depository 140 may include a media recycler, media cartridges, and/or media dispenser.

Figure 2:
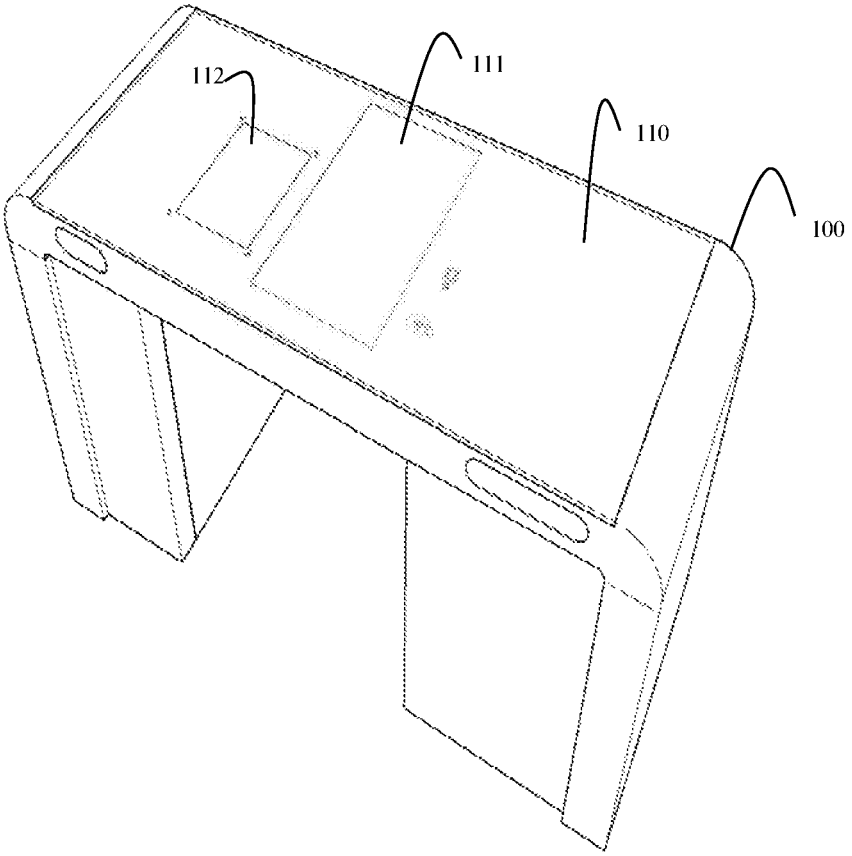
FIG. 2 is a diagram of a top-down view of a transaction terminal, according to an example embodiment.

FIG. 2 is a diagram of a top-down view of a transaction terminal 100, according to an example embodiment.

FIG. 2 illustrates and an arrangement of operating surface 110 with an enlarged touchscreen display interface 111 and document scanner 112. Touchscreen display interface 111 is resizable within operating surface 110 and the orientation from side to side can be changed. Moreover, touchscreen display interface 111 can be moved through touch or reoriented from a first side to a second side with a gesture-based touch (such as tossing from one side to an opposite side.

Operating surface 110 is horizontally oriented as a table-top configuration. Touchscreen display interface 111 is interacted with by looking downward onto operating surface 110 and touching components of the user-transaction interface during processing of a transaction.

In an embodiment, side car 130 is situated under one side of operating surface 110 whereas valuable media depository 140 is situated under and to an opposite side of operating surface 110.

Figure 3:
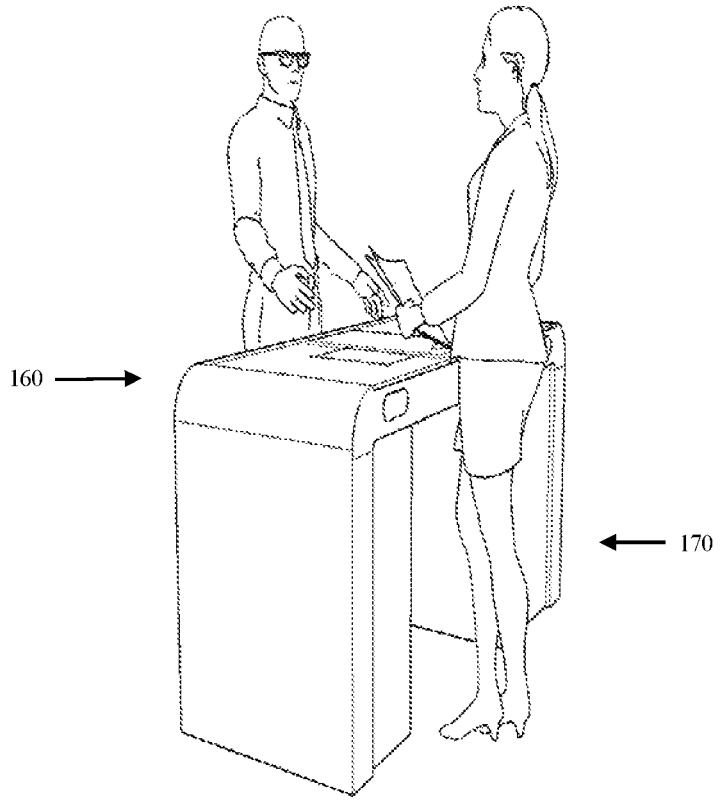
FIG. 3 is a diagram of a transaction terminal configured for teller-service, according to an example embodiment.

FIG. 3 is a diagram of a transaction terminal 100 configured for teller-service, according to an example embodiment.

FIG. 3 illustrates a teller-service mode of operation during which a teller is situated to one side 170 during a transaction and a customer is situated to the opposing side 160. The teller and customer are able to stand face-to-face during the transaction and look downward onto operating surface 110 for interacting with the user-transaction interface during the transaction.

Figure 4:
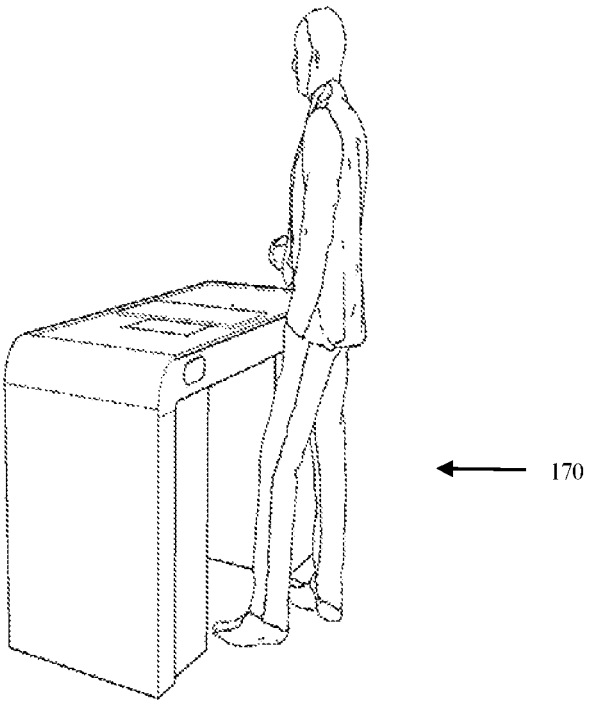
FIG. 4 is a diagram of a transaction terminal configured for self-service, according to an example embodiment.

FIG. 4 is a diagram of a transaction terminal 100 configured for self-service, according to an example embodiment.

FIG. 4 illustrates that terminal 100 can be placed in a self-service mode of operation for transaction processing, such that a customer interacts with touchscreen display interface 111 on side 170 (the side with media receiving and dispensing interfaces 121 and 122 (shown and discussed in the FIG. 15 below).

Figure 5:
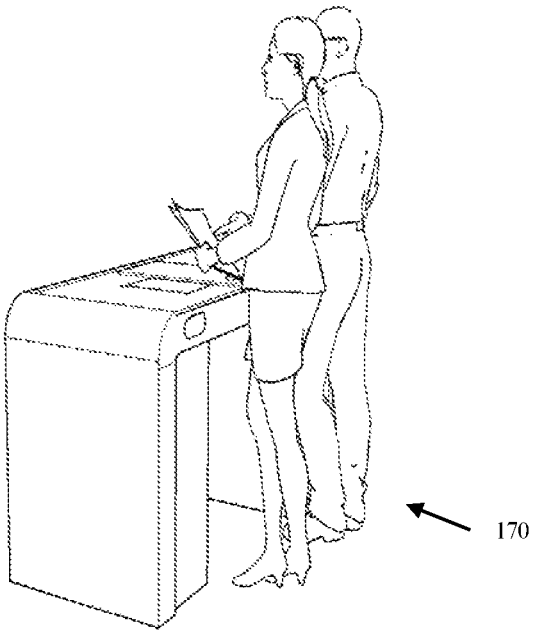
FIG. 5 is a diagram of a transaction terminal configured for assisted-service.

FIG. 5 is a diagram of a transaction terminal 100 configured for assisted-service.

In assisted-service mode of operation both the customer and the teller are situated on a single side 170 of terminal 100 (again the side having the media receiving and dispensing interfaces 121 and 122).

Figure 6:
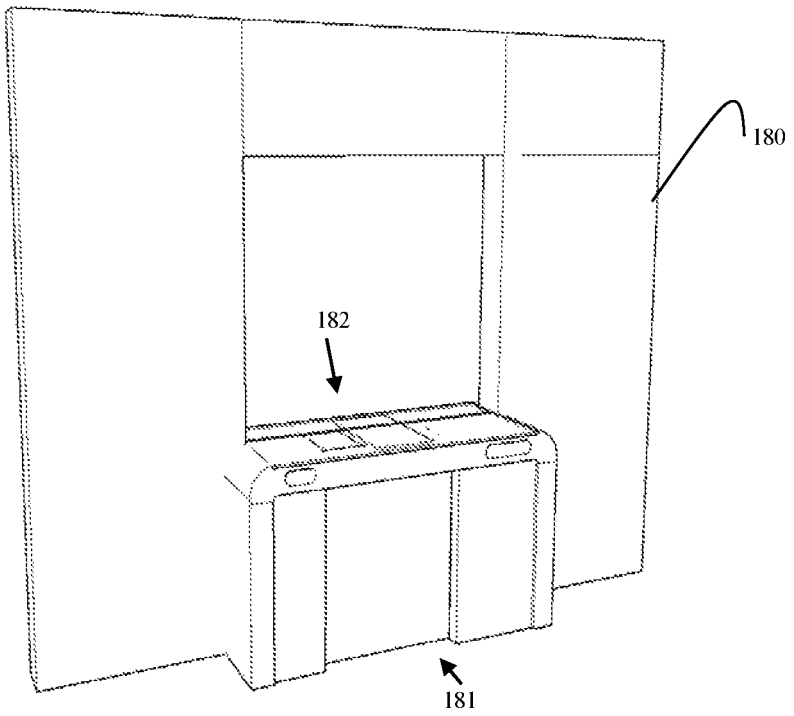
FIG. 6 is a diagram of a transaction terminal configured for secure teller-service, according to an example embodiment.

FIG. 6 is a diagram of a transaction terminal 100 configured for secure teller-service, according to an example embodiment.

Terminal 100 is divided into two portions 181 and 182 separated by a secure wall or partition 180. Side 181 faces a customer and includes operating surface 110. However, a portion of operating surface 110 is blocked by partition 180 where a teller can interact with a different portion of operating surface 110 on side 182. Partition 180 can include a see-through bullet proof glass/plastic. Moreover, access to depository 140 is only available on enclosed side 182.

In an embodiment, a portion of the glass that abuts a top of operating surface 110 may be darkened such that neither a teller nor a customer can view each other's operating surface 110. This provides privacy for the customer and the teller during teller-service modes of operation.

During times where a teller is unavailable, side 181 along with operating surface 110 may be operated on the self-service mode of operation. Media pocket interfaces 121 and 122 (discussed with FIG. 15 below) are accessible for customer deposits and withdrawals. As such, terminal 100 is available for customer use even when staff is unavailable for teller-service. Side 181 may also be used to operate terminal 100 in an assisted-service mode of operation.

Figure 7:
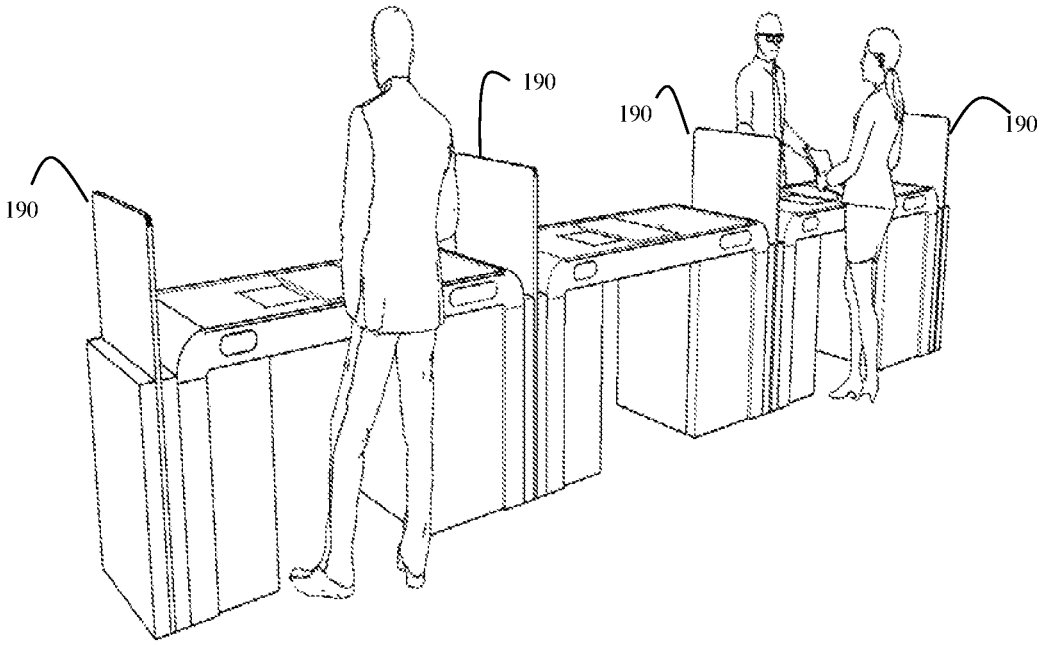
FIG. 7 is a diagram of transaction terminals configured for multiple disparate modes of service, according to an example embodiment.

FIG. 7 is a diagram of transaction terminals 110 configured for multiple disparate modes of service, according to an example embodiment.

Terminals 110 can be aligned with one another in a row forming multiple independent terminals 110. Each terminal 100 can be operating in different of same modes as the other terminals 110 in the row. Each terminal 100 is separated by partitions 190. Advantageously, each partition 190 may extend upward from a top of operating surface 110 to a height that inhibits operators of an adjacent terminal 100 from being able to view operating surface 110 of an abutting terminal 100. This provides operational privacy with an open environment.

Figure 8:
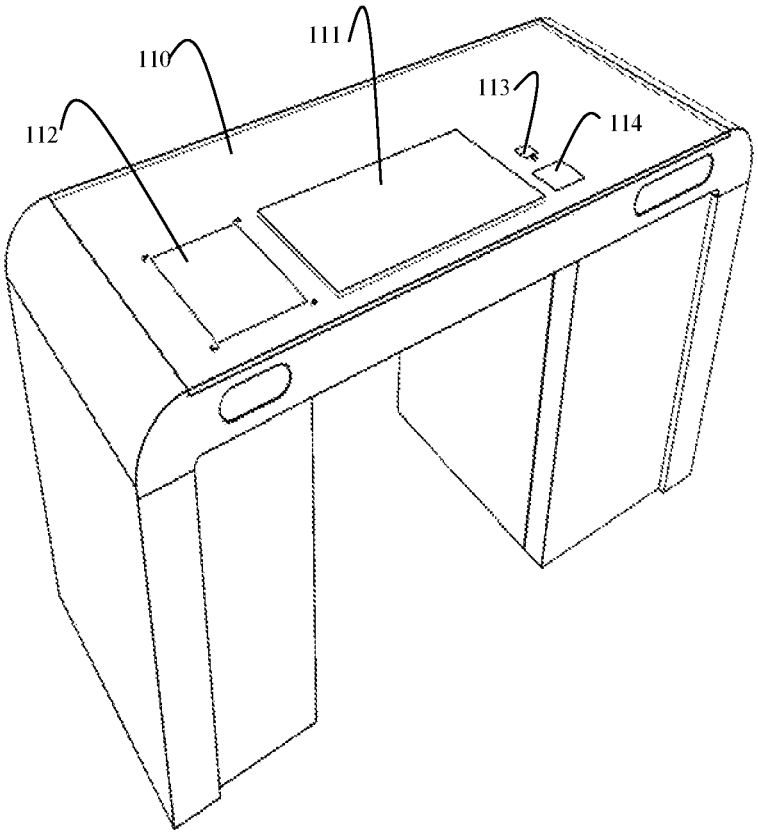
FIG. 8 is a diagram illustrating top surface components of a transaction terminal, according to an example embodiment.

FIG. 8 is a diagram illustrating top surface components of a transaction terminal 100, according to an example embodiment.

A variety of integrated components may lie beneath operating surface 110 of terminal 100.

A consistent component is at least one touch-screen display 111. The size dimensions of touch-screen display 111 can vary and can be dynamically resized on operating surface 110.

In an embodiment, touch-screen display 111 is a tablet computer integrated into operating surface 110.

Operating surface 110 may also include a document scanner 112 for copying and scanning images of documents or photo identification cards.

Furthermore, operating surface 110 may also include a contactless card reader (e.g., Near Field Communication (NFC) transceiver) 113. This allows tokens to be exchanged through contactless cards and/or mobile devices (e.g., phones) during a transaction with terminal 100.

Additionally, operating surface 110 may include a barcode or Quick Response (QR) reader 114.

Still further, biometric devices and cameras may be integrated into operating surface 110, such a fingerprint readers, retinal scanners, palm readers, digit distance measurers, security cameras, and others.

In an embodiment, a portion of operating surface 110 includes a weigh scale.

In an embodiment, barcode scanner 114 includes an integrated weigh scale.

In an embodiment, operating surface 110 includes position sensors that detect the presence and orientation of an operator adjacent to or standing over operating surface 110. This can include motion based sensors, light based sensors, thermal sensors, and the like.

Moreover, operating surface 110 and/or side surface 120 may include integrated speakers and microphones for audio feedback and voiced-based transaction processing at terminal 100.

Figure 9:
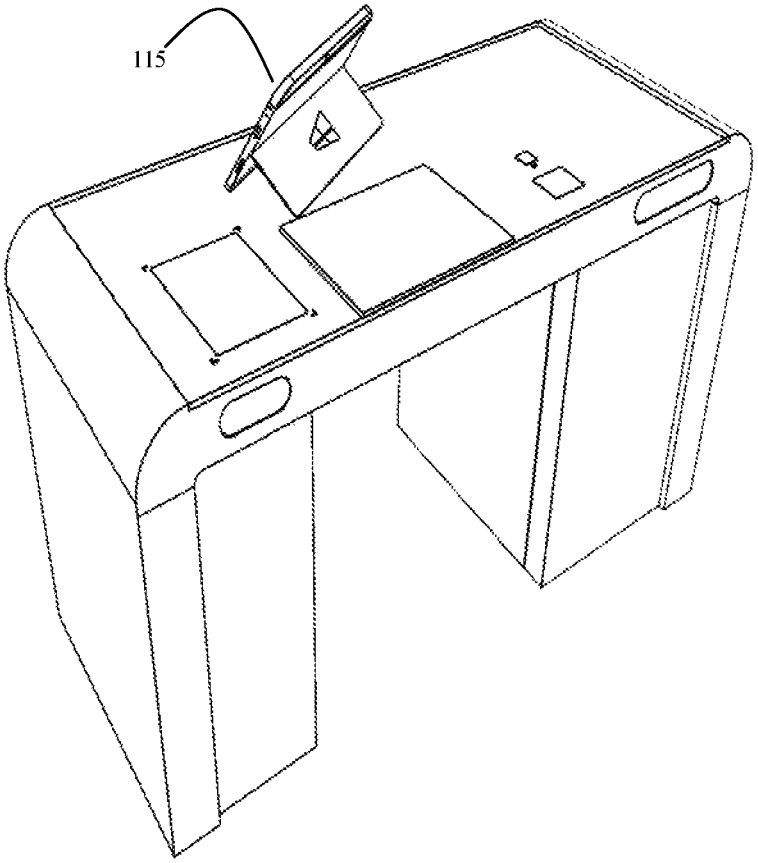
FIG. 9 is a diagram illustrating wireless modular components of a transaction terminal, according to an example embodiment.

FIG. 9 is a diagram illustrating wireless modular components of a transaction terminal 100, according to an example embodiment.

Wireless tablet 115 may be included with or interfaced to terminal 100 through a wireless transceiver of terminal 100. Wireless transceiver may include BlueTooth®, BlueTooth® Low Energy (BLE), Wi-Fi, NFC, and/or Radio Frequency (RF).

Tablet 115 allows for wireless mobile device interaction with terminal 100 and operating surface 110 during transaction processing.

Figure 10:
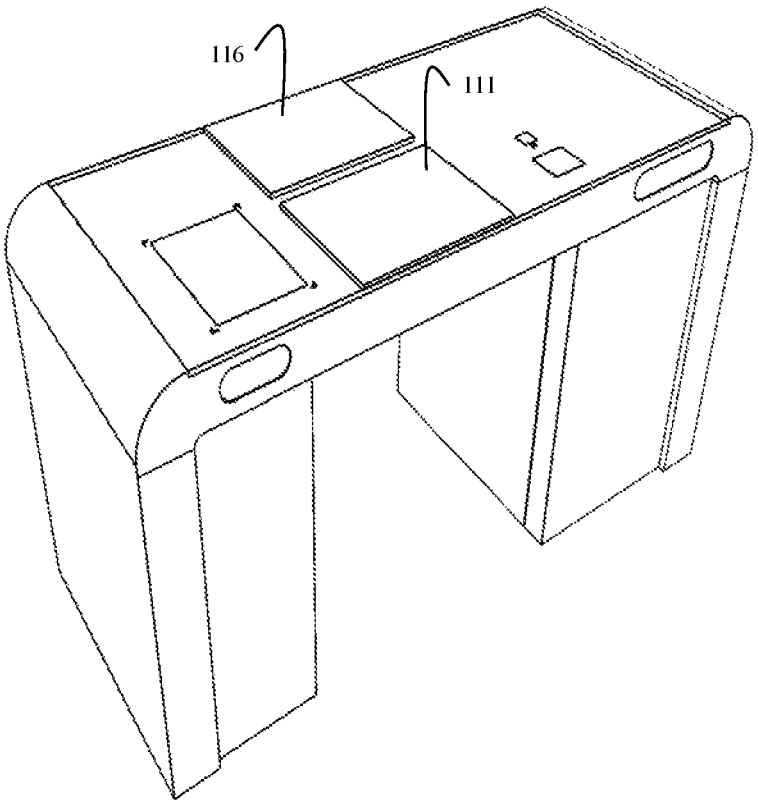
FIG. 10 is a diagram of spit or dual touchscreen components of a transaction terminal, according to an example embodiment.

FIG. 10 is a diagram of spit or dual touchscreen components of a transaction terminal 100, according to an example embodiment.

Operating surface 110 may include two-separate and independent integrated touchscreen displays 111 and 116. Each touchscreen display 111/116 oriented on a particular side of operating surface 110, such that one may be dedicated for a customer, such as 111, and one is dedicated for a teller, such as 116. The designations may be changed such that a teller may operate on either side of operating surface 110 as well as the customer, but both the customer and the teller have his/her own independent touchscreen display 111/116.

Furthermore, the two touchscreen displays 111 and 116 may be synchronized during transaction processing with one another, such that a gesture touch movement made on display 111 in the direction of display 116 causes a transaction object (such as a document that needs to be signed by a customer) to be passed to display 116 where the customer can use a finger and/or a stylus to sign the documents electronically during transaction processing. Thus, displays 111 and 116 may interact with one another during transaction processing.

Figure 11:
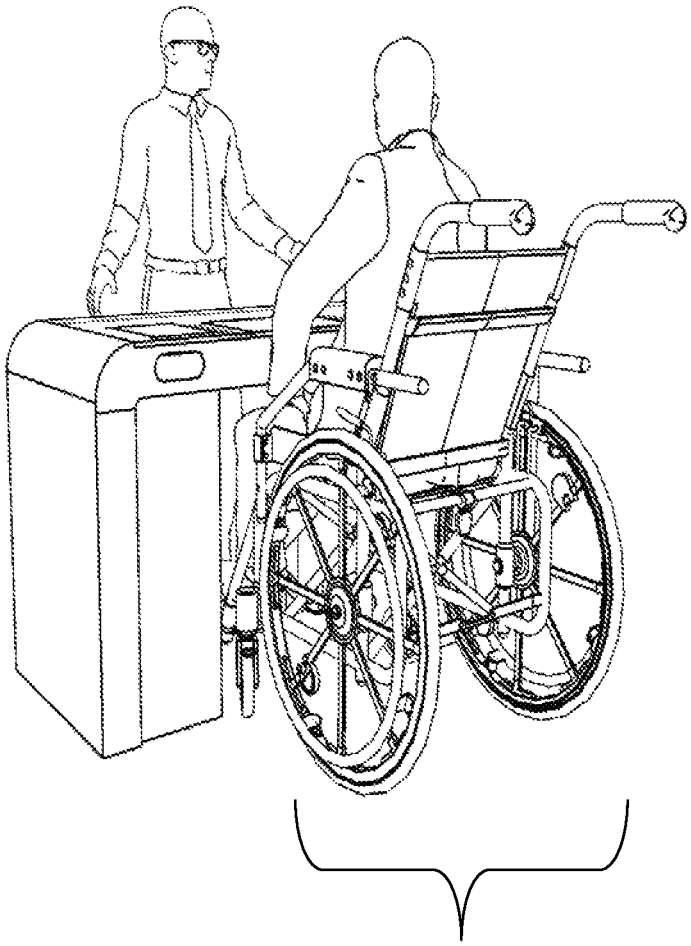
FIG. 11 is a diagram of a handicap accessible transaction terminal, according to an example embodiment.

FIG. 11 is a diagram of a handicap accessible transaction terminal 100, according to an example embodiment.

Terminal 100 may be configured such that an aperture, gap, or space 150 extends below a bottom of operating surface 110. The size of aperture 150 may comply with disability access regulations, such that terminal 100 is wheelchair accessible (as illustrated in FIG. 11).

Terminal 100 in FIG. 11 is arranged as a table, such that a wheelchair customer can locate his/her legs while remaining in the wheelchair under a bottom portion of operating surface 110. Operating surface 110 can then be interacted with by the customer for a self-service mode of operation.

In an embodiment, operating surface 110 also includes raised textiles features, such that a visually impaired customer may perform self-service transaction with operating surface 110 and terminal 100.

In an embodiment, an audio jack is integrated into operating surface 110 and/or side surface 120, such that visually impaired customers can insert headphone jacks for audio-guided transaction processing.

Figure 12:
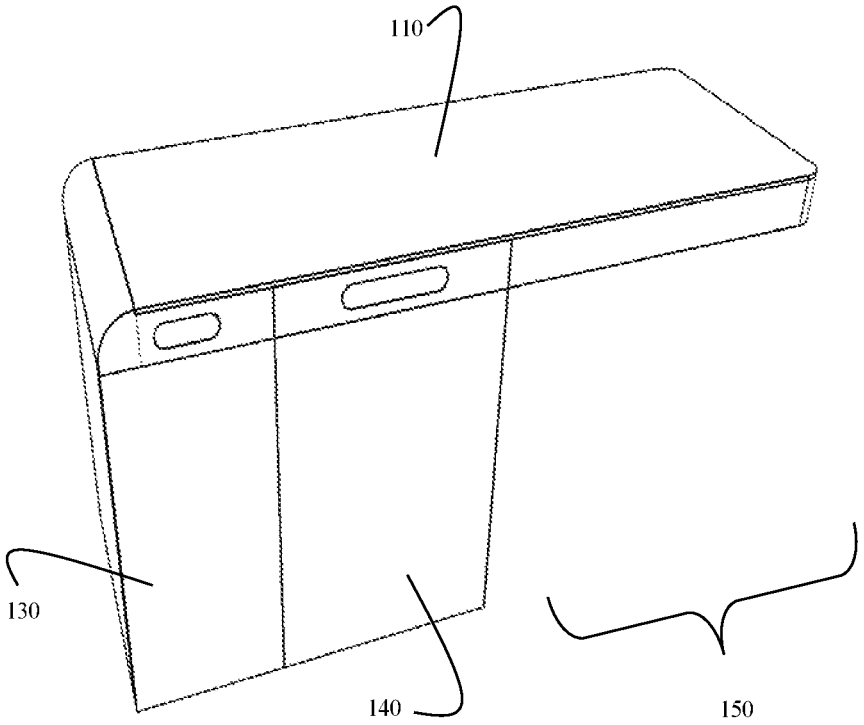
FIG. 12 is a diagram of an open-sided transaction terminal, according to an example embodiment.

FIG. 12 is a diagram of an open-sided transaction terminal 100, according to an example embodiment.

A portion of operating surface 110 may not be supported by any perpendicular vertical supports, such that aperture 150 is not enclosed by side car 130 on one side and depository 140 on an opposite side; rather both side car 130 and depository 140 are on under and support operating surface 110 on a single side. This permits even larger wheelchairs that are beyond a scope of existing disability accessibility regulations to comfortably fit under operation surface 110 for self-service transaction on terminal 100.

In an embodiment, the unsupported and extended end of operating surface 110 may include a vertical partition, such as what was shown above in FIG. 7 as partition 190. Vertical partition extends from the floor up above operating surface 110, such that a plurality of terminals 100 can be arranged similarly to what was shown in FIG. 7. Moreover, touchscreen display 111 may be accessible on the extended and unsupported operating surface 110 so that customers and tellers would interact with terminals 100 in areas near each partition. This would provide privacy for each operator at each terminal 100 arranged in a linear row of terminals 100.

Figure 13:
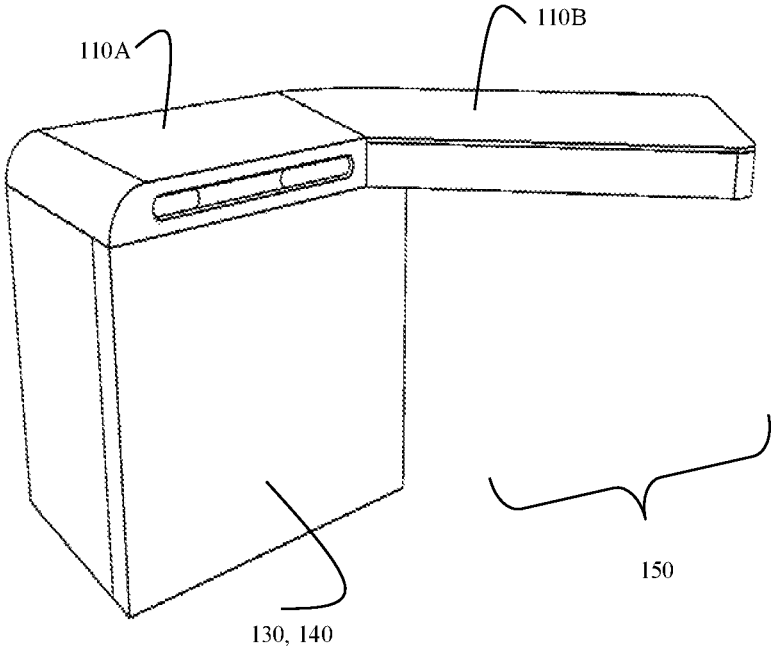
FIG. 13 is a diagram of an open-sided and angled transaction terminal, according to an example embodiment.

FIG. 13 is a diagram of an open-sided and angled transaction terminal 100, according to an example embodiment.

Operating surface 110 is segmented into two separate portions 110A and 110B in FIG. 13. Each portion 110A/110B may include different integrated components.

FIG. 13 also illustrates a curved relationship between operating surface portions 110A and 110B. That is, portion 110A abuts portion 110B at an angle. Such configuration, would allow terminal 100 to be arranged with other terminals 110 in non-linear relationships, such as arcs, semi-circles, circles, etc. Inside of the arcs may include tellers while the outside of the arcs may include customers. The customers access one side of operating surfaces 110 for the terminals 100 while the tellers access opposite sides of operating surfaces 110.

Moreover, terminals 110 arranged with the curved relationship between two separate portions 110A and 110B of operating surface 110 may allow the extend and open ends 110B to be abutted against one another from terminal 100 to terminal 100. This may be advantageous to have tellers operating at different terminals 100 to be adjacent and next to one another while assisting different customers for different transactions so that they can rely on one another for advice when expertise of a teller is needed. This also allows for discrete consultation between tellers during different transactions occurring at different terminals 100.

Figure 14:
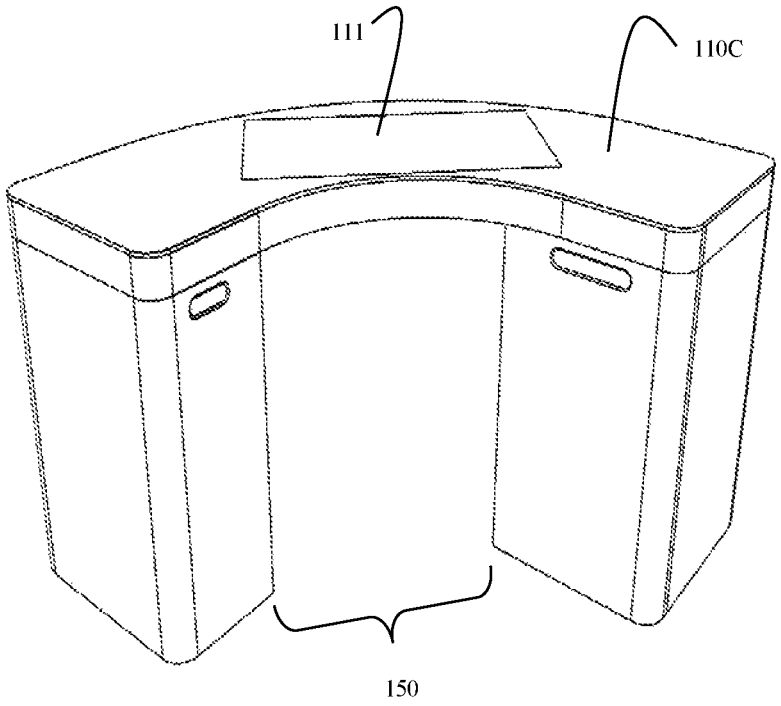
FIG. 14 is a diagram of a curved transaction terminal, according to an example embodiment.

FIG. 14 is a diagram of a curved transaction terminal 100, according to an example embodiment.

Operating surface 110 is configured as a semi-circle operating surface 110C in FIG. 14. Touchscreen display 111 is enlarged as an oversized touch screen on operating surface 110. Such an arrangement may permit two terminals 100 to be arranged to create a circle with access areas on the sides. Tellers may operating within the circle with customers remaining outside the circle.

Figure 15:
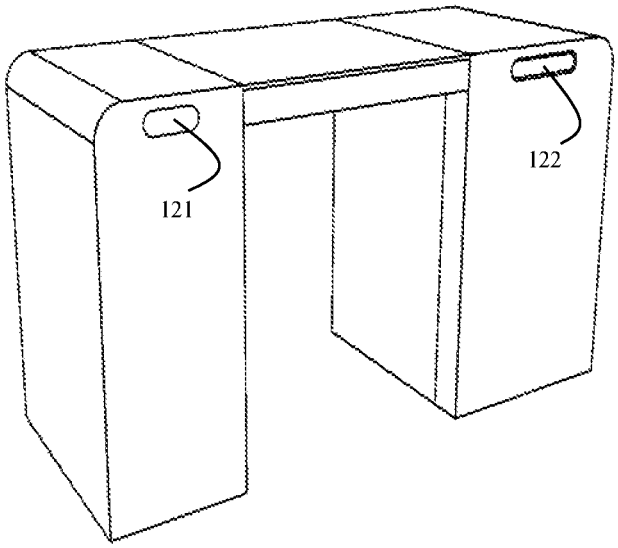
FIG. 15 is a diagram illustrating media interfaces of a transaction terminal, according to an example embodiment.

FIG. 15 is a diagram illustrating media interfaces of a transaction terminal 100, according to an example embodiment.

FIG. 15 illustrates media pocket interfaces 121 and 122. I first media pocket interface 121 is integrated into sides surface 120 above side car 130 and a second media pocket interface 122 is integrated into side surface 120 above depository 140.

The pocket interfaces 121 and 122 may include: check and currency deposit interfaces, currency dispensers, coin dispensers, ticket dispensers, receipt printer dispensers (print outs), etc.

In an embodiment, side surface 120 also includes an integrated magnetic card reader.

In an embodiment, terminal 100 includes a single pocket interface 121 or 122, which supports both deposits and dispensing media.

Figure 16:
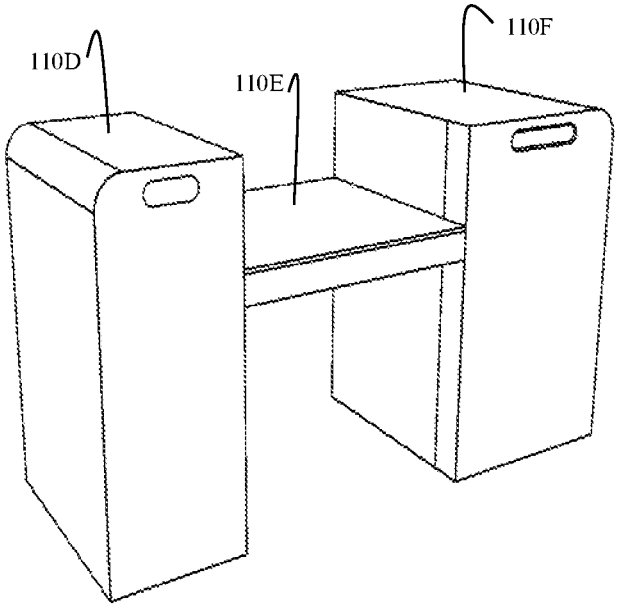
FIG. 16 is a diagram split-level operating surface of a transaction terminal, according to an example embodiment.

FIG. 16 is a diagram split-level operating surface of a transaction terminal 100, according to an example embodiment.

Operating surface 110 is segmented into the separate portions 110D, 110E, and 110F. Operating surface 110E may include touchscreen display 111. Additionally, surfaces 110D and/or 110F may include additional, cooperating and interacting touchscreen displays (as was shown and discussed in FIG. 10 above. Surfaces 110D and 110F are at a same vertical height relative to a floor/ground as one another, whereas surface 110E is offset vertically below surfaces 110D and 110F at a lower vertical height relative to the floor/ground.

In an embodiment, the vertical height of surface 110E relative to the ground is adjustable, through a slot mechanism in side car 130 and depository 140, such that surface 110E can be brought up the same height as surfaces 110D and 110F for a flush surface or moved downward in a position illustrated in FIG. 16. Advantageously, this allows for smaller customers to adjust surface 110E to a comfortable height for transaction processing during self-service at terminal 100.

Figure 17:
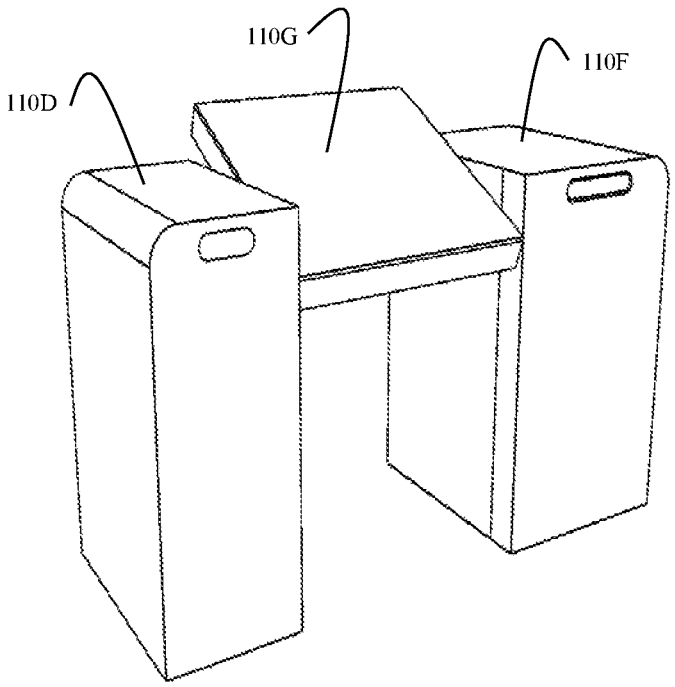
FIG. 17 is a diagram of split-level and adjustable operating surface of a transaction terminal, according to an example embodiment.

FIG. 17 is a diagram of split-level and adjustable operating surface of a transaction terminal, according to an example embodiment.

Operating surface 110 is broken into three components 110D, 110G, and 110F similar to what was shown in FIG. 16; however, surface 110G is adjustable in an angular direction for custom tilting surface 110G. The range of tilt is approximately 90 degrees, 45 degrees toward one side of terminal 100, back to a parallel flat horizontal position of surface 110G, and then 45 degrees toward the other opposing side. So, surface 110G can be custom tilted for operation to either side of terminal 100.

This allows the operator to view operating surface 110G without looking downward or looking nearly directly ahead of the operator.

In an embodiment, the range of tilt is approximately 180 degrees (90 degrees to each side of terminal 100).

In an embodiment, terminal 100 is an Automated Teller Machine (ATM).

In an embodiment, terminal 100 is a self-service grocery checkout or retail checkout station.

A mode of operation for terminal 100 can be dynamically changed back and forth from teller-service, self-service, assisted-services.

In an embodiment, three different modes are configured dynamically by physically switching the position of the displayed information on the horizontal display 111.

This position of the interface 111 may be controlled by the teller via a selection button on the display 111, or could be switched by using a gesture such a spinning and sliding what is on the display interface 111 towards the user, and then slid back to face them. This could be to put the teller in self-service or assisted-service or during a teller transaction to show the customer something on the display 111, or direct the user to perform an action, for example. Within any of the three mode states the terminal 100 is in, a teller can take control of the interface 111 and switch it into a different mode, should they have need.

In another configuration the teller could have a remote handheld device 115 to control the terminal 100, a smaller display 111 on the table top terminal 100 being provided for the user.

In self-service mode the displayed information is turned to face the customer side of the teller counter. The terminal 100 mode of operation is thereby be switched automatically to an interface lead-through of a terminal 100. The customer would control the terminal 100 and carry out transactions unaided.

In assisted-service mode the displayed information is turned at an angle suitable for the teller and customer to see it. The system could remain in a self-service mode and interface, or a unique assisted lead-through interface could be displayed. The customer can control the terminal 100 aided by the teller, or the teller could show the customer how it is used.

In another variant the teller could be in a call center remote from the terminal 100, and through a telephone handset and video link on the display 1111 an assisted transaction could take place.

In teller-service mode the displayed information would be turned towards the teller side facing away from the customer side. In this mode the interface 111 and terminal 100 would be in full control of the teller. The teller would direct the customer to take items from the sidecar 130 or the recycler/depository 140.

The three major components can be configured physically together numerous other different ways, some of which were discussed above with the FIGS.

The terminal 100 and configurations are particularly suitable for use within a mini branch environment.

The terminal 100 is suitable for use within a secure counter arrangement.

There are a number of different bridging configurations possible.

The display 111 incorporated can be of different sizes, and positions, within the table top terminal 100. It could be orientated landscape so users can use it side by side. It could be 2 separate displays side by side or one at the teller side and one at the user side.

The terminal 100 can contain other devices such as a contactless card reader 113, a bar code 114 and a document scanner 112, security features such as cameras, sensors and biometric devices for customer verification. These are digital, or solid state devices, which do not have to require handing and storing physical media.

However, as discussed above, there could also be incorporated media handling devices such as a magnetic or dip card reader or a receipt printer in the table top for customers who wish to provide these as alternatives to digital only.

The table top terminal 100 can also incorporate accessibility features such as audio lead through and tactile discernible input device such as a tactile strip, or UNav, or gestural interaction.

The free space 150 underneath the table top terminal 100 that bridges the security enclosure 140 and the sidecar 130 has been designed dimensionally to accommodate front approach in a wheelchair.

The operating surface 110 a weighing scale and scanner in the table top terminal 100 so it can be used as a self-service checkout.

In an embodiment, the orientation of touchscreen display 111 can be changed with touch-based gestures on touchscreen display 111. The orientation can face one side of terminal 100 and dynamically switched to the other side. The orientation within a given side can be portrait or landscape.

In an embodiment, a displayable area of touchscreen display 111 is dynamically resizable with touch-based gestures (such as pinch-in pinch-out using one or both hands of the operator on the touchscreen display surface.

In an embodiment, a single touchscreen display 111 can be dynamically broken through a touch option or gesture into two separate logically cooperating split touchscreen displays with each separate display oriented to one side of terminal 100.

In an embodiment, the touchscreen display 111 is approximately a 26 inch diagonal integrated tablet into operating surface 110.

In an embodiment touchscreen display 111 is a solid state device that is a digital display countertop terminal devices with a variety of integrated components as discussed above into the operating surface 110.

In an embodiment, touchscreen display 111 includes touch-based options for placing terminal 100 into self-service, teller-service, and assisted-service modes of operation.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A terminal, comprising:

a horizontal operating surface comprising a touchscreen display;

a first vertical support comprising first integrated devices; and a second vertical support comprising second integrated devices;

wherein a bottom portion of the horizontal operating surface rests on tops of the first vertical support and the second vertical support;

wherein the terminal is configured to dynamically switch between different modes of operation based on touch interaction with the touchscreen display, and each mode of operation configured to:

activate and deactivate selective first integrated devices and selective second integrated devices; and orient displayed information in the touchscreen display to one side or both sides of the horizontal operating surface.

2. The terminal of claim 1, wherein the horizontal operating surface further includes a second touchscreen display.

3. The terminal of claim 1, wherein horizontal operating surface comprises third integrated devices that are integrated below a top surface of the horizontal operating surface.

4. The terminal of claim 3, wherein the third integrated devices include one or more of: a document scanner, a barcode scanner, a biometric scanner, a wireless card reader, a camera, a microphone, a speaker, and position sensors.

5. The terminal of claim 1 further comprising, a side surface adjacent to the horizontal operating surface, wherein the side surface includes an integrated magnetic card reader.

6. The terminal of claim 5, wherein the side surface further includes an integrated media pocket interface configured to dispense media and accept deposited media.

7. The terminal of claim 1, wherein the first integrated devices include one or more of: a coin dispenser, a check/currency acceptor, a receipt printer, and a magnetic card reader.

8. The terminal of claim 7, wherein the second integrated devices include one or more of: a media depository, a media recycler, and a currency dispenser.

9. The terminal of claim 1, wherein the touch display is configured to change a particular orientation of the displayed information, a particular size of the displayed information, and a particular side for which the displayed information is presented on the touch display based on touch gestures made on a touch surface of the touch display.

10. A terminal, comprising:

an adjustable horizontal operating surface comprising a touchscreen display;

a first vertical component comprising first integrated devices; and a second vertical component comprising second integrated devices; wherein the terminal is configured to:

dynamically switch between modes of operation;

orient displayed information within the touchscreen display based on an activated mode of operation; and selectively activate and deactivate the first integrated devices and the second integrated devices based on the activated mode of operation.

11. The terminal of claim 10, wherein the first vertical component is situated under a bottom of the adjustable horizontal operating surface on a first end and the second vertical component is situated under the bottom of the adjustable horizontal operating surface on a second and opposing end.

12. The terminal of claim 11, wherein a space between the first vertical component, the second vertical component, and the bottom of the adjustable horizontal operating surface is sized to accommodate a wheelchair.

13. The terminal of claim 12, wherein a portion of the adjustable horizontal operating surface that is above the space is adjustable vertically along sides of the first vertical component and the second vertical component, and wherein the portion includes the touchscreen display.

14. The terminal of claim 13, wherein the adjustable horizontal operating surface that is above the space is rotatable 90 degrees from a horizontal position in two directions.

15. The terminal of claim 10, wherein the first vertical component and the second vertical component are situated under a bottom of the adjustable horizontal operating surface on one side of the adjustable horizontal operating surface and an opposing side of the adjustable horizontal operating surface includes no vertical support member and creates a portion of the adjustable operating surface that is unsupported and that overhangs.

16. The terminal of claim 10, wherein the adjustable horizontal operating surface is curved in a semi-circular shape and is supported on one end by the first vertical component and on an opposing end by the second vertical component.

17. The terminal of claim 10, wherein at least a portion of the touchscreen display includes raised tactile features.

18. A terminal, comprising:

an operating surface comprising first integrated devices and a touch screen display;

a side surface that abuts the operating surface comprising an integrated magnetic card reader;

a vertical side car comprising a first media pocket interface, a check holding area, and a receipt printer, wherein the vertical side car is situated under a bottom of the operating surface; and a vertical safe enclosure comprising, a media depository, a media repository, and a second media pocket interface, wherein the vertical safe enclosure is stated under the bottom of the operating surface;

wherein the terminal is configured to:

dynamically change an orientation, size, and location of displayed information presented during a transaction on the touch screen display based on touch interaction or a mode of operation for the terminal; and dynamically activate and deactivate selective ones of the first integrated devices based on the mode of operation of the terminal.

19. The terminal of claim 18, wherein the terminal is configured to operate in a self-service mode of operation, a teller-service mode of operation, and an assisted-service mode of operation.

20. The terminal of claim 19, wherein the terminal is configured in a self-service mode of operation to operate as an Automated Teller Machine or a Self-Service Checkout Terminal.

* * * * *